US008627677B2

(12) United States Patent
Anell et al.

(10) Patent No.: US 8,627,677 B2
(45) Date of Patent: Jan. 14, 2014

(54) ICEMAKER ASSEMBLY FOR A REFRIGERATOR

(75) Inventors: Thomas Carl Anell, Knoxville, IL (US); Michael Scot Carden, Williamsburg, IA (US); Kenton John Widmer, Williamsburg, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 2343 days.

(21) Appl. No.: 11/393,857

(22) Filed: Mar. 31, 2006

(65) Prior Publication Data

US 2007/0227176 A1 Oct. 4, 2007

(51) Int. Cl.
*F25C 1/04* (2006.01)

(52) U.S. Cl.
USPC ..... 62/340; 62/69

(58) Field of Classification Search
USPC ..... 62/66–71, 74, 340–356
See application file for complete search history.

(56) References Cited

U.S. PATENT DOCUMENTS

| | | | | |
|---|---|---|---|---|
| 3,048,986 | A | 8/1962 | Archer | |
| 3,055,186 | A | 9/1962 | Linstromberg et al. | |
| 3,182,464 | A | 5/1965 | Archer | |
| 3,206,940 | A | 9/1965 | Archer | |
| 3,280,584 | A | 10/1966 | Grimm et al. | |
| 3,382,682 | A | 5/1968 | Frohbieter | |
| 3,449,919 | A | 6/1969 | Fox | |
| 3,775,992 | A | 12/1973 | Bright | |
| 4,727,720 | A | 3/1988 | Wernicki | |
| 4,852,359 | A | 8/1989 | Mazzotti | |
| 6,351,955 | B1 * | 3/2002 | Oltman et al. | 62/71 |
| 6,438,988 | B1 * | 8/2002 | Paskey | 62/353 |
| 6,543,249 | B2 | 4/2003 | Kim et al. | |
| 6,655,158 | B1 | 12/2003 | Wiseman et al. | |
| 6,679,073 | B1 | 1/2004 | Hu | |
| 6,708,509 | B1 * | 3/2004 | Senner | 62/137 |
| 6,732,537 | B1 | 5/2004 | Anell et al. | |
| 6,742,353 | B2 | 6/2004 | Ohashi et al. | |
| 6,895,767 | B2 | 5/2005 | Hu | |
| 6,945,068 | B2 | 9/2005 | Kim et al. | |
| 7,185,508 | B2 * | 3/2007 | Voglewede et al. | 62/353 |
| 2004/0177626 | A1 * | 9/2004 | Hu | 62/135 |
| 2004/0237565 | A1 | 12/2004 | Lee et al. | |
| 2005/0061016 | A1 | 3/2005 | Lee et al. | |
| 2005/0076654 | A1 | 4/2005 | Chung | |
| 2005/0160756 | A1 | 7/2005 | Lee et al. | |
| 2005/0217284 | A1 | 10/2005 | An et al. | |

FOREIGN PATENT DOCUMENTS

| | | |
|---|---|---|
| JP | 2247468 | 10/1990 |
| JP | 409033155 | 2/1997 |
| JP | 11148763 | 6/1999 |
| JP | 11173732 | 7/1999 |
| JP | 11173733 | 7/1999 |

(Continued)

*Primary Examiner* — Cheryl J Tyler
*Assistant Examiner* — David Teitelbaum

(57) ABSTRACT

An icemaker assembly for a refrigerator includes a support bracket having at least one support arm and a rear panel section, a bin slidably attached to the at least one support arm, an icemaker unit having an ice mold is also supported by the at least one support arm within the freezer compartment. The icemaker assembly also includes a fan mounted to the rear panel portion of the support bracket. The fan is selectively operable to direct an airflow onto the icemaker unit in order to speed ice production. Operation of the fan is tied to activation of a water inlet valve. A controller is coupled to the fan and the water inlet valve such that once the water inlet valve opens, fresh water enters the ice mold and the control activates the fan to hasten the production of ice.

16 Claims, 3 Drawing Sheets

(56) References Cited

FOREIGN PATENT DOCUMENTS

| | | |
|---|---|---|
| JP | 2000329436 | 11/2000 |
| JP | 2001272145 | 10/2001 |
| JP | 2001289544 | 10/2001 |
| JP | 2002031464 | 1/2002 |
| JP | 2004036974 | 2/2004 |
| JP | 2004125214 | 4/2004 |
| WO | WO 2004/036127 | 4/2004 |

* cited by examiner

ICEMAKER ASSEMBLY FOR A REFRIGERATOR

BACKGROUND OF THE INVENTION

1. Field of the Invention

The present invention pertains to the art of refrigerators and, more particularly, to a refrigerator having an icemaker assembly provided with a fan that is selectively operable to speed ice formation.

2. Discussion of the Prior Art

Whether to ensure an adequate amount of ice for a party, or to keep up with daily demand, there is a need to decrease ice production time. To address this concern in the art of refrigerated appliances, it is known to employ fans or other similar devices to direct air across an ice mold in order to decrease ice production time. Typically, the fan is oriented to direct a flow of air from an evaporator over the ice mold. The flow of air disturbs a thermal barrier that is present about the ice mold in order to increase temperature transfer rates and, as a consequence, decrease an amount of time required to form ice.

While the above described arrangements simply utilize fans, other arrangements expose the ice mold directly to the evaporator and utilize an evaporator fan to blow cool air. In some cases the evaporator is part of a primary refrigeration system that is employed to maintain temperatures in a fresh food and freezer compartment of the refrigerator, while in other cases the evaporator is dedicated to ice production. Dedicated evaporators are typically employed in systems which locate the icemaker in a portion of the refrigerator other than the freezer compartment. While effective, the above described systems typically rely on a cooling demand signal to operate. That is, regardless of a need for ice, the above described systems only function when either the fresh food or freezer compartment requires cooling which necessitates the activation of the refrigeration system. Correspondingly, even during periods when no ice production is required, the above described systems function upon activation of the refrigeration system.

Regardless of the teachings in the prior art, there still exists a need for an enhanced system to reduce ice production time in a refrigerator. More specifically, there exists a need for system that is selectively operated to decrease ice production time regardless of a need for cooling in compartments of the refrigerator.

SUMMARY OF THE INVENTION

The present invention is directed to a refrigerator including a cabinet, a freezer compartment located in the cabinet and an icemaker assembly mounted in the freezer compartment. In accordance with the invention, the icemaker assembly includes a support bracket having at least one support arm and a back plate, and a bin slidably attached to the at least one support arm. An icemaker unit having an ice mold is also supported by the at least one support arm within the freezer compartment. Furthermore, the icemaker assembly includes a fan that is mounted to the back plate of the support bracket. The fan is selectively operable to direct an airflow onto the icemaker unit in order to speed ice production. Preferably, the fan directs the airflow onto, around and below the icemaker, disrupting a thermal barrier to speed ice cube formation.

In accordance with the most preferred form of the invention, operation of the fan is tied to activation of an icemaker water inlet valve through a controller. After an ice harvest cycle, i.e., when ice cubes are deposited from the icemaker unit into a storage bin, the icemaker water inlet valve opens, allowing fresh water into the icemaker unit to refill the ice mold. As fresh water enters the ice mold, the controller activates the fan to blow air across, around and below the ice mold to speed ice production. The controller is also preferably coupled to a timer that limits operation of the fan to a predetermined time period.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
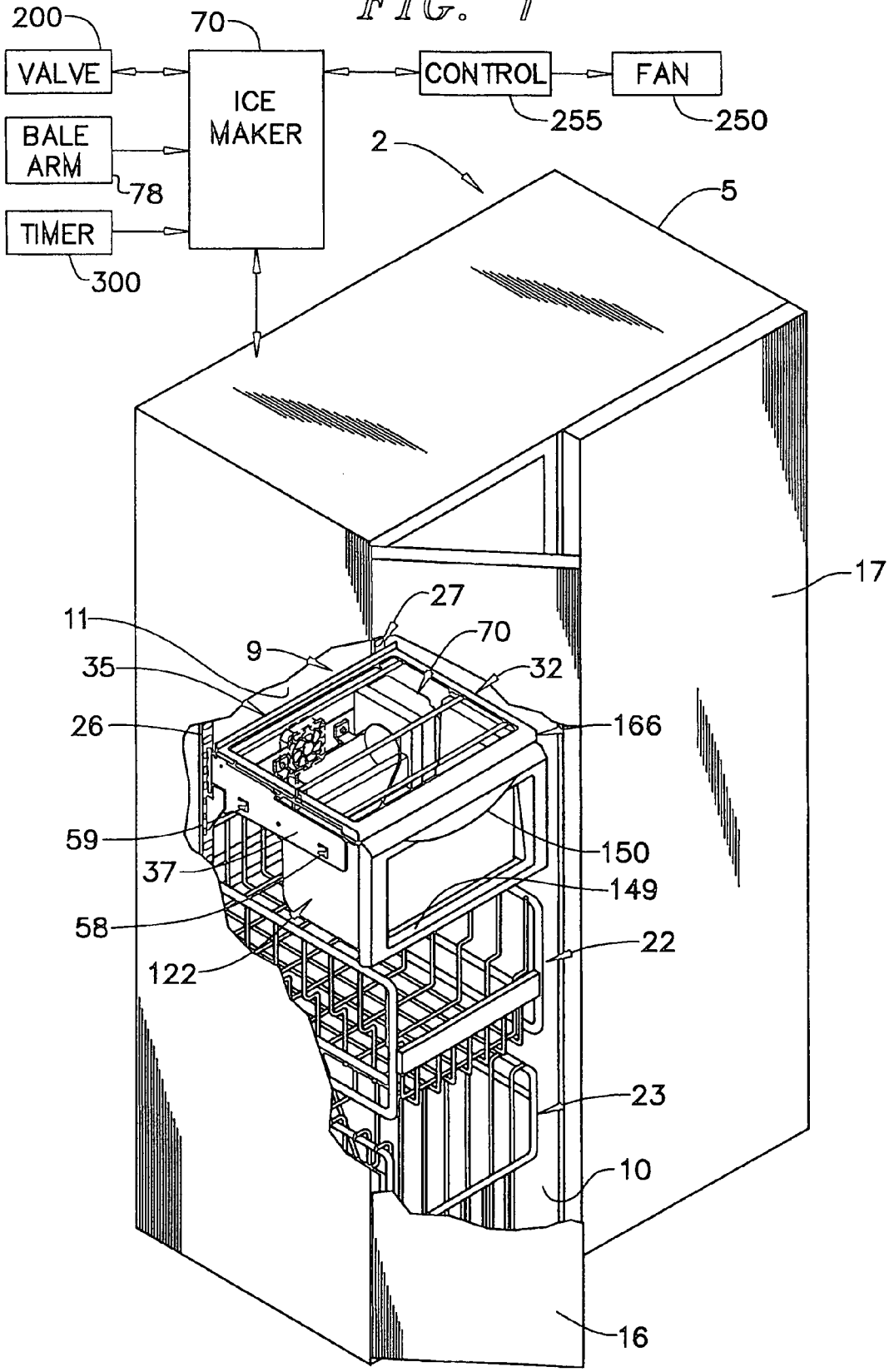
FIG. 1 is an upper left partial sectional view, of a side-by-side refrigerator incorporating an icemaker assembly including a fan constructed in accordance with the present invention.

With initial reference to FIG. 1, the present invention will be described with respect to a side-by-side refrigerator which is generally indicated at 2. As shown, refrigerator 2 includes a cabinet shell 5 within which is provided a freezer compartment 9 defined, at least in part, by a side wall 10 and a back wall 11. Freezer compartment 9 can be selectively accessed by means of a pivotally mounted freezer door 16. Adjacent freezer door 16 is a fresh food door 17, behind which is arranged a fresh food compartment (not shown). In a manner known in the art, freezer compartment 9 is preferably provided with a plurality of storage baskets 22 and 23, as well as a pair of vertically extending support rails 26 and 27 provided at laterally spaced positions along back wall 11. Obviously, this basic structure for refrigerator 2 is widely known in the art and therefore has only been provided for the sake of completeness.

Figure 2:
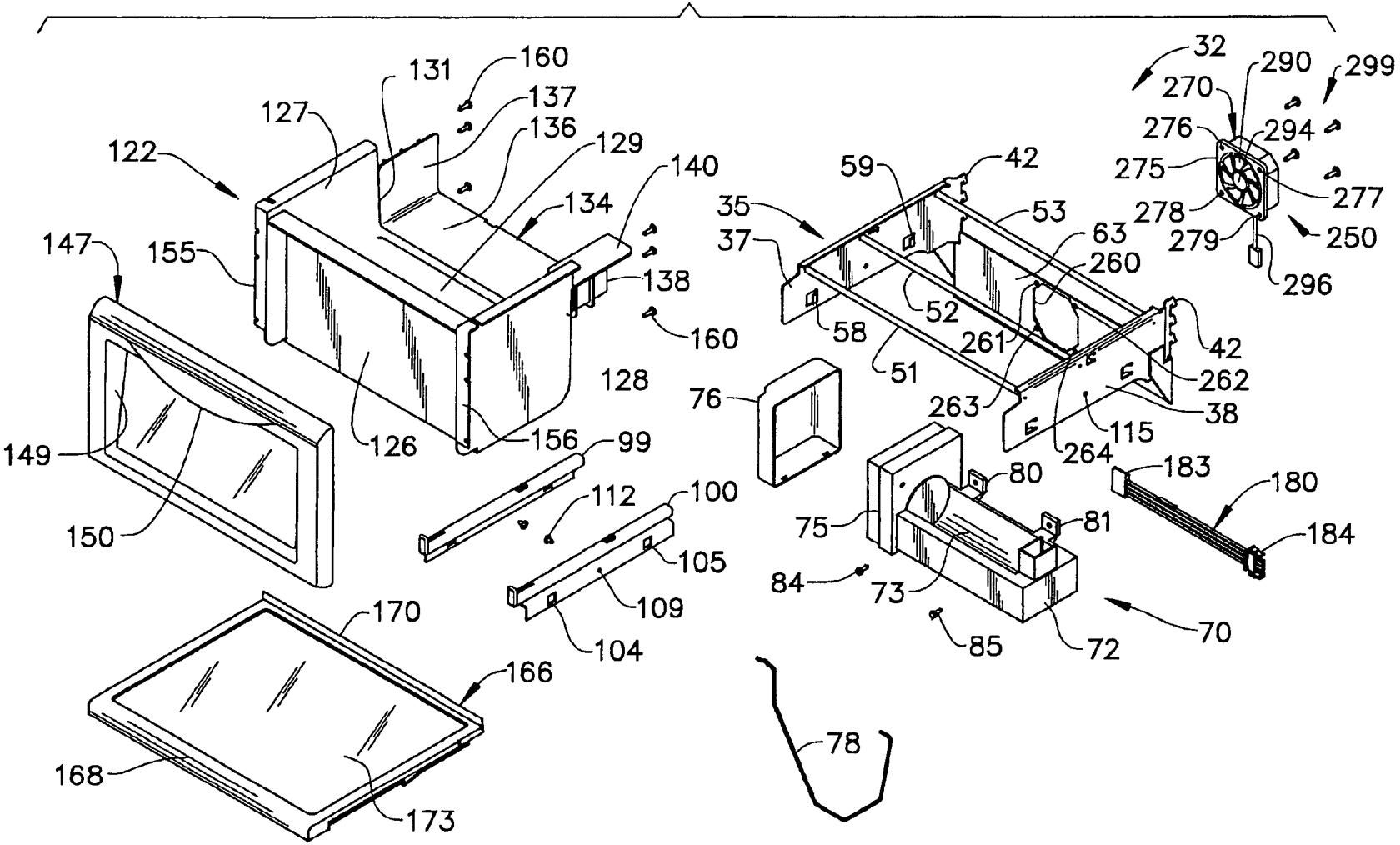
FIG. 2 is an exploded view of the icemaker assembly of FIG. 1.

The present invention is particularly directed to the incorporation of an icemaker assembly 32 within refrigerator 2. With particular reference to FIGS. 1 and 2, icemaker assembly 32 includes a support bracket 35 having a pair of laterally spaced support arms 37 and 38, each of which is provided with a plurality of rear hook elements 42. Interconnecting support arms 37 and 38 are a plurality of fore-to-aft spaced cross braces 51-53. Each support arm 37, 38 is preferably made of metal and, as best shown in FIG. 2, includes a pair of spaced tabs 58 and 59 which are lanced out of each support arm 37, 38. Support bracket 35 also includes a back plate 63 which interconnects support arms 37 and 38. Actually, in the most preferred form of the invention, back plate 63 wraps around and is fixedly secured to support arms 37 and 38. Support bracket 35 is adapted to be hung, in a cantilevered manner, from support rails 26 and 27 with the use of hook elements 42.

Icemaker assembly 32 also includes an icemaker unit 70 having a main body portion 72, a trough or ice mold portion 73, a motor end mount 75, an end cover 76 and a bale arm 78. In general, the construction and operation of icemaker unit 70 is known in the art and does not form part of the present invention. However, in accordance with the invention, icemaker unit 70 is secured to back plate 63 so as to be suspended at a select vertical location upon support rails 26 and 27 through support arms 37 and 38. Although icemaker unit 70 could be attached to support arms 37 and 38 in a variety of ways, in accordance with the embodiment shown, icemaker unit 70 is provided with a pair of brackets 80 and 81 which are fixed to back plate 63 by means of screws 84 and 85.

Also preferably provided as part of icemaker assembly 32 is a pair of side rails 99 and 100. As shown, each side rail 99, 100 is formed with a pair of spaced openings 104 and 105, as well as a central aperture 109. With this construction, each side rail 99, 100 can be positioned against a respective support arm 37, 38, with openings 104, 105 receiving a corresponding one of tabs 58 and 59. A screw 112 is provided which extends through aperture 109 and is threadably received in an opening 115 provided in a respective support arm 37, 38.

Icemaker assembly 32 also includes an ice storage bin 122. Most preferably, bin 122 is integrally molded of plastic to include a front wall 126, side walls 127 and 128, a bottom wall 129 and an open rear wall portion 131. In addition, bin 122 preferably includes a ledge member 134 having a base 136, upstanding sides 137 and 138, and an upper plateau portion 140. Furthermore, bin 122 is provided with a separate front panel 147 having a recessed zone 149 and a handle portion 150. As shown, side walls 127 and 128 lead to front, outturned flanges 155 and 156. In the embodiment shown, front panel 147 is fixed across front wall 126 by means of a plurality of screws 160 which extend through flanges 155 and 156 and into front panel 147 from behind.

Icemaker assembly 32 also includes a shelf 166 having a peripheral rim 168, an upstanding rear strip 170 and a platform 173 which is preferably made from a visually transparent material such as glass, but which could be opaque. In general, platform 173 is encapsulated by rim 168 to define a spill-proof shelf. It should be recognized that encapsulating shelving of this type is known for use in at least fresh food compartments of refrigerators. In accordance with the present invention, shelf 166 is mounted upon support arms 37 and 38 above icemaker unit 70. In one preferred embodiment, shelf 166 is fixed upon support arms 37 and 38. However, it should be understood that shelf 166 could readily be mounted for sliding movement into and out from freezer compartment 9 relative to support arms 37 and 38. Finally, a wire harness 180 is provided. Wire harness 180 includes opposing terminal connectors 183 and 184 for providing required electrical connections to icemaker unit 70, preferably through back wall 11. Although not shown, a water supply tube would also be routed to icemaker unit 70. The water supply tube would be connected to a valve, which is schematically indicated at 200 in FIG. 1 and, as will be detailed more fully below, is selectively operated by icemaker unit 70 upon sensing a demand for ice from, for example, bale arm 78.

In accordance with the invention, icemaker assembly 32 includes a fan 250 that is selectively operated to speed the production of ice within icemaker unit 70. As will be discussed more fully below, fan 250 is coupled to a controller 255. In any case, fan 250 is preferably mounted at a central opening 260 provided in back plate 63. In addition to central opening 260, back plate 63 also includes a plurality of mounting apertures 261-264 for mounting fan 250 in a manner that will be described more fully below. Fan 250 is shown in FIG. 2 to include a main housing 270 having a mounting flange 275 that is provided with a plurality of openings 276-279 which are designed to align with mounting apertures 261-264. Fan 250 also includes a plurality of blades 290 that project outwardly from a central hub 294. Finally, a central electrical coupler 296 extends from main housing 270 to electrically interconnect fan 250 with controller 210.

Figure 3:
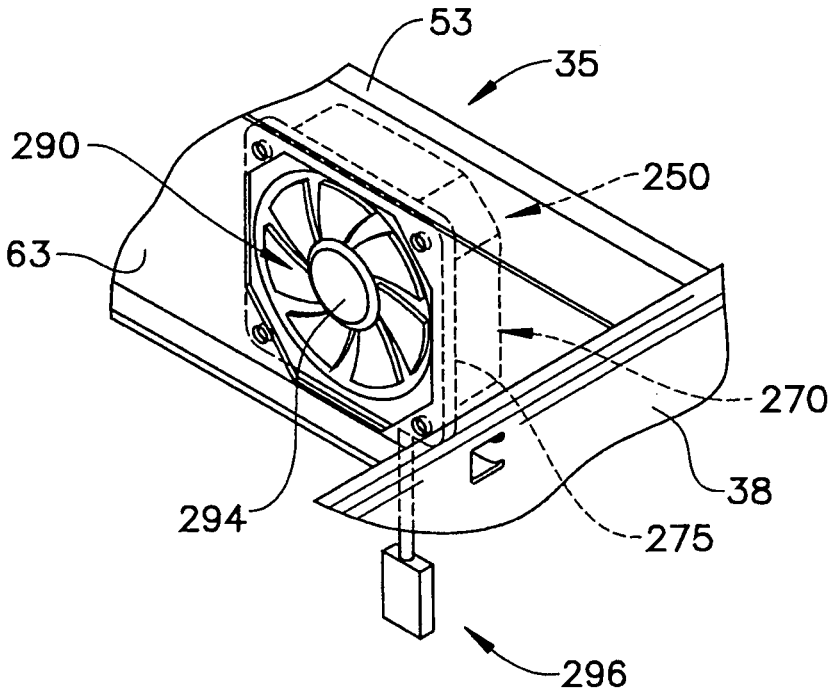
FIG. 3 is an upper left perspective view of the fan mounted in accordance with the present invention.

As best shown in FIGS. 2 and 3, fan 250 is positioned behind back plate 63 at central opening 260 with mounting openings 276-279 aligning with mounting apertures 261-264. Once aligned, a plurality of mechanical fasteners, such as indicated at 299, are employed to connect fan 250 to back plate 63. Of course, it should be understood that the particular type of fastening arrangement can vary in accordance with the present invention and can include screws, rivets and other types of connecting members. With this mounting arrangement, fan 250 can be readily mounted, electrically connected and vertically adjustable in unison with icemaker unit 70.

In accordance with the most preferred form of the invention, fan 250 is activated upon the cycling of valve 200. More specifically, upon sensing a need for ice, icemaker unit 70 opens valve 200 allowing water to enter into the ice mold portion 73. After valve 200 closes or, alternatively, prior to the closing of valve 200, controller 255 activates fan 250. Upon activation, fan 250 directs a cooling airflow over, across and about icemaker unit 70 to increase a mass flow of cold air about ice mold 73 and hasten the formation of ice. That is, by increasing the mass flow of cold air, fan 250 speeds the heat transfer between the water and the air in freezer compartment 9, causing ice to form within icemaker unit 70 quicker that would otherwise be possible. Preferably, fan 250 is operated for a predetermined time period established by a timer 300 that is coupled to controller 250. The duration of the time period is established as a factory setting which may be subsequently altered or adjusted by a technician if necessary. In any case, the preferred mounting of fan 250 ensures a uniform airflow distribution about icemaker unit 70 such that the mass flow of cold air covers the entire icemaker unit 70 and not merely about portions thereof.

Although described with reference to a preferred embodiment of the invention, it should be readily understood that various changes and/or modifications can be made to the invention without departing from the spirit thereof. For instance, while shown as a side-by-side model, the present invention could also be incorporated into top mount, bottom mount, French door, built-in or free-standing, and dedicated freezer models. In addition, it should be understood that the refrigerator could be provided with operator controls that enable the icemaker fan to be selectively de-activated by a consumer if so desired. Finally, although shown separately, it should be understood that the controller can be provided as part of the icemaker unit. In general, the invention is only intended to be limited by the scope of the following claims.

We claim:

1. A refrigerator comprising:

a cabinet;

a freezer compartment located in the cabinet, said freezer compartment being defined, at least in part, by a back wall; and an icemaker assembly mounted in the freezer compartment, said icemaker assembly including:

a support bracket mounted in the freezer compartment, said support bracket including at least one support arm and a back plate extending across the back wall, wherein the back plate includes an opening and is spaced from said back wall of the freezer compartment;

an icemaker unit supported by the at least one support arm within the freezer compartment, said icemaker unit being adapted to produce ice cubes; and a fan mounted at the opening of the back plate, said fan being selectively operable to draw air from between the back plate and the back wall to create an airflow directed onto the icemaker unit to speed ice production.

2. The refrigerator according to claim 1, wherein the opening is positioned centrally along the back plate.

3. The refrigerator according to claim 1, further comprising:

a water valve selectively shiftable between a closed state blocking a flow of water to the icemaker unit and an open state allowing passage of water into the icemaker unit; and a controller operatively coupled to the valve and the fan, said controller being adapted to activate the fan when the valve is in the open state.

4. The refrigerator according to claim 3, wherein the controller activates the fan when the valve changes from the closed state to the open state.

5. The refrigerator according to claim 3, wherein the controller operates the fan for a predetermined time period.

6. The refrigerator according to claim 1, further comprising: a pair of vertically extending support rails fixed in the freezer compartment, said support bracket being mounted to the pair of vertically extending support rails so as to be selectively, vertically repositionable, together with the bin and the fan, within the freezer compartment.

7. The refrigerator according to claim 6, further comprising: a bin slidably attached to the at least one support arm for selective movement into and out of the freezer compartment.

8. The refrigerator according to claim 7, further comprising: a shelf mounted upon the support bracket, said shelf being vertically repositionable in unison with both the icemaker and the fan.

9. A refrigerator comprising:

a cabinet;

a freezer compartment located in the cabinet, said freezer compartment being defined, at least in part, by a back wall; and an icemaker assembly mounted in the freezer compartment, said icemaker assembly including:

a support bracket mounted in the freezer compartment, said support bracket including at least one support arm and a back plate;

an icemaker unit supported by the at least one support arm within the freezer compartment, said icemaker unit being adapted to produce ice cubes;

a fan selectively operable to direct an airflow onto the icemaker unit to speed ice production;

a pair of vertically extending support rails fixed in the freezer compartment, said support bracket being mounted to the pair of vertically extending support rails so as to be selectively, vertically repositionable, together with the bin and the fan, within the freezer compartment;

a water valve selectively shiftable between a closed state blocking a flow of water to the icemaker unit and an open state allowing passage of water into the icemaker unit; and a controller operatively coupled to the valve and the fan, said controller being adapted to activate the fan when the valve is in the open state.

10. The refrigerator according to claim 9, wherein the controller activates the fan when the valve changes from the closed state to the open state.

11. The refrigerator according to claim 9, wherein the controller operates the fan for a predetermined time period.

12. The refrigerator according to claim 9, further comprising: a bin slidably attached to the at least one support arm for selective movement into and out of the freezer compartment.

13. The refrigerator according to claim 12, further comprising: a shelf mounted upon the support bracket, said shelf being vertically repositionable in unison with both the icemaker and the fan.

14. A method of rapidly producing ice in an icemaker unit mounted to a support bracket attached to a wall of a freezer compartment, said method comprising:

opening a water inlet valve allowing water to flow into an icemaker unit mounted to the support bracket;

guiding the water into an ice mold portion of the icemaker unit; and activating a fan mounted to a back plate portion of the support bracket upon opening the water inlet valve, the back plate portion extending across the wall of the freezer compartment, said fan drawing air from between the back plate portion and a rear wall of the freezer compartment to create an airflow directed onto the icemaker unit and disrupting a thermal barrier about the ice mold in order to speed ice production.

15. The method of claim 14, further comprising: vertically repositioning the icemaker and the fan simultaneously.

16. The method of claim 14, further comprising: terminating operation of the fan after a predetermined time period has elapsed.

* * * * *